United States Patent [19]

Sasaki et al.

[11] Patent Number: 4,899,471

[45] Date of Patent: Feb. 13, 1990

[54] AUGER FOR SELF-PROPELLED SNOW REMOVING MACHINE

[75] Inventors: Ichiro Sasaki; Takeo Ogano, both of Saitama, Japan

[73] Assignee: Honda Giken Kogyo Kabushiki Kaisha, Tokyo, Japan

[21] Appl. No.: 373,687

[22] Filed: Jun. 30, 1989

Related U.S. Application Data

[63] Continuation of Ser. No. 62,431, Jun. 12, 1987, abandoned.

[30] Foreign Application Priority Data

Jun. 18, 1986 [JP] Japan ..... 61-142598
Nov. 7, 1986 [JP] Japan ..... 61-171211[U]

[51] Int. Cl.[4] ..... E01H 5/09
[52] U.S. Cl. ..... 37/233; 37/258
[58] Field of Search ..... 37/233, 257, 258, 259, 37/248–252, 254, 256, 81, 213; 198/513, 625, 664, 661, 669; 414/526

[56] References Cited

U.S. PATENT DOCUMENTS

| | | | |
|---|---|---|---|
| 158,482 | 1/1875 | Foye | 37/257 |
| 505,806 | 10/1893 | Allfree | 198/664 |
| 1,754,699 | 4/1930 | Snyder | 198/513 |
| 2,669,338 | 2/1954 | Voling | 198/513 |
| 2,735,199 | 2/1956 | Wanner et al. . | |
| 3,132,429 | 5/1964 | Etnyre | 37/254 |
| 3,429,061 | 2/1969 | Haban . | |
| 3,485,341 | 12/1969 | Lutz | 198/664 |
| 3,673,715 | 7/1972 | Lines | 37/251 |
| 3,913,247 | 10/1975 | Ruhl | 37/258 |
| 4,514,917 | 5/1985 | Ogano et al. | 37/249 |
| 4,619,061 | 10/1986 | Swanson | 37/248 |

FOREIGN PATENT DOCUMENTS

| | | | |
|---|---|---|---|
| 1195704 | 10/1985 | Canada . | |
| 0623916 | 8/1978 | U.S.S.R. | 37/249 |
| 0742524 | 7/1980 | U.S.S.R. | 37/249 |
| 2758 | 7/1879 | United Kingdom | 198/264 |

OTHER PUBLICATIONS

French Patent Application Search Report, Aug. 3, 1989.

*Primary Examiner*—E. N. Eickholt
*Attorney, Agent, or Firm*—Irving M. Weiner; Joseph P. Carrier; Pamela S. Burt

[57] ABSTRACT

An auger in a self-propelled snow removing machine including a running mechanism drivable by an engine, and a snow blower for discharging snow collected by the auger, comprises an auger cover disposed on a front portion of the snow removing machine, an auger output shaft disposed transversely in the auger cover and drivable by the engine, and at least one blade mounted on the auger output shaft and having an outer peripheral edge forming a substantially continuous helix around the auger output shaft. The blade comprises a plurality of mutually separate fins having outer peripheral edges jointly forming the helix and made of a resilient steel material.

13 Claims, 7 Drawing Sheets

AUGER FOR SELF-PROPELLED SNOW REMOVING MACHINE

This application is a continuation of prior U.S. patent application Ser. No. 62,431, filed June 12, 1987, abandoned concurrently with the filing of the present application.

BACKGROUND OF THE INVENTION

1. Field of the Invention

The present invention relates to an auger for a snow removing machine, and more particularly to a self-propelled snow removing machine having crawlers or drive wheels and an auger which are driven by a single engine.

2. Description of the Relevant Art

Various snow-removing machines have heretofore been proposed which have a single engine for driving crawlers or drive wheels and an auger driven by the engine for removing snow. One snow-removing machine of this type is disclosed in U.S. Pat. No. 3,913,247 patented Oct. 21, 1975. The auger of the disclosed snow-removing machine has a shaft supported transversely in an auger cover or housing mounted on a front portion of a body frame and a plurality of blades mounted on the shaft which is rotated by the engine. Each of the blades comprises two sector-shaped fins with their inner apexes welded to the shaft. One end of the outer peripheral edge of one of the fins is welded to one end of the outer peripheral edge of the other fin, so that their outer peripheral edges jointly form a helix around the shaft. The helical structure of the fins allows the blades to form a cylindrical shape when they are rotated around the shaft. The fins are cold formed from sheet metal, preferably No. 12 gauge, and are stiff and inflexible. The helix formed by the outer peripheral edge of one blade is relatively long. Therefore, the blades and the auger cover may be deformed by small stones or other foreign matter that may enter between the blades and the auger cover.

U.S. Pat. No. 3,132,429 patented May 12, 1964 shows another snow removing machine wherein one blade of the auger is constructed of racket-shaped paddles coupled to a transverse drive shaft. The paddles have cylindrical shanks fitted in respective bosses or radial bases mounted on the drive shaft at prescribed pitches in a helical pattern. The cylindrical shanks are fixed to the drive shaft by screws threaded into the bosses. The angle at which each paddle is inclined with respect to the axis of the drive shaft is adjustable, so that the auger can vary its shearing angle with respect to snow in various conditions. When the paddle angle with respect to the drive shaft is selected to be large in order to remove heavy snow, the outer peripheral edges of the blades are discontinuous, thus avoiding the problem experienced with the former U.S. Patent. However, when the paddle angle with respect to the drive shaft is selected to be small in order to remove lightweight snow, the outer peripheral edges of the blades are substantially continuous, and the problem of the former U.S. Patent cannot be solved. Moreover, in U.S. Pat. No. 3,132,429, the screws by which the paddles are fastened to the drive shaft may be loosened during use of the snow removing machine, so that the paddle angle with respect to the drive shaft may vary from an initial angle setting.

The present invention has been made in an effort to solve the aforesaid problems of the conventional auger constructions for snow removing machines.

SUMMARY OF THE INVENTION

It is an object of the present invention to provide an auger structure for a self-propelled snow removing machine, which can avoid deformation of blades and an auger housing even when small stones or foreign matter enters between the blades and the auger housing.

To achieve the above object, there is provided in accordance with the present invention an auger in a self-propelled snow removing machine including an engine, running means drivable by the engine, and a snow blower for discharging snow collected by the auger, the auger comprising an auger cover disposed on a front portion of the snow removing machine, an auger output shaft disposed transversely in the auger cover and drivable by the engine, and at least one blade mounted on the auger output shaft and having an outer peripheral edge forming a substantially continuous helix around the auger output shaft. The blade comprises a plurality of mutually separate fins having outer peripheral edges jointly forming the helix and made of a resilient steel material.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 13 is a front elevational view of an auger fin;

FIG. 14 is a side elevational view of an auger fin;

FIG. 15 is a cross-sectional view taken along line XV—XV of FIG. 13; and FIG. 16 is a view as viewed in the direction of the arrow XVI in FIG. 9.

DETAILED DESCRIPTION OF THE PREFERRED EMBODIMENTS

Figure 1:
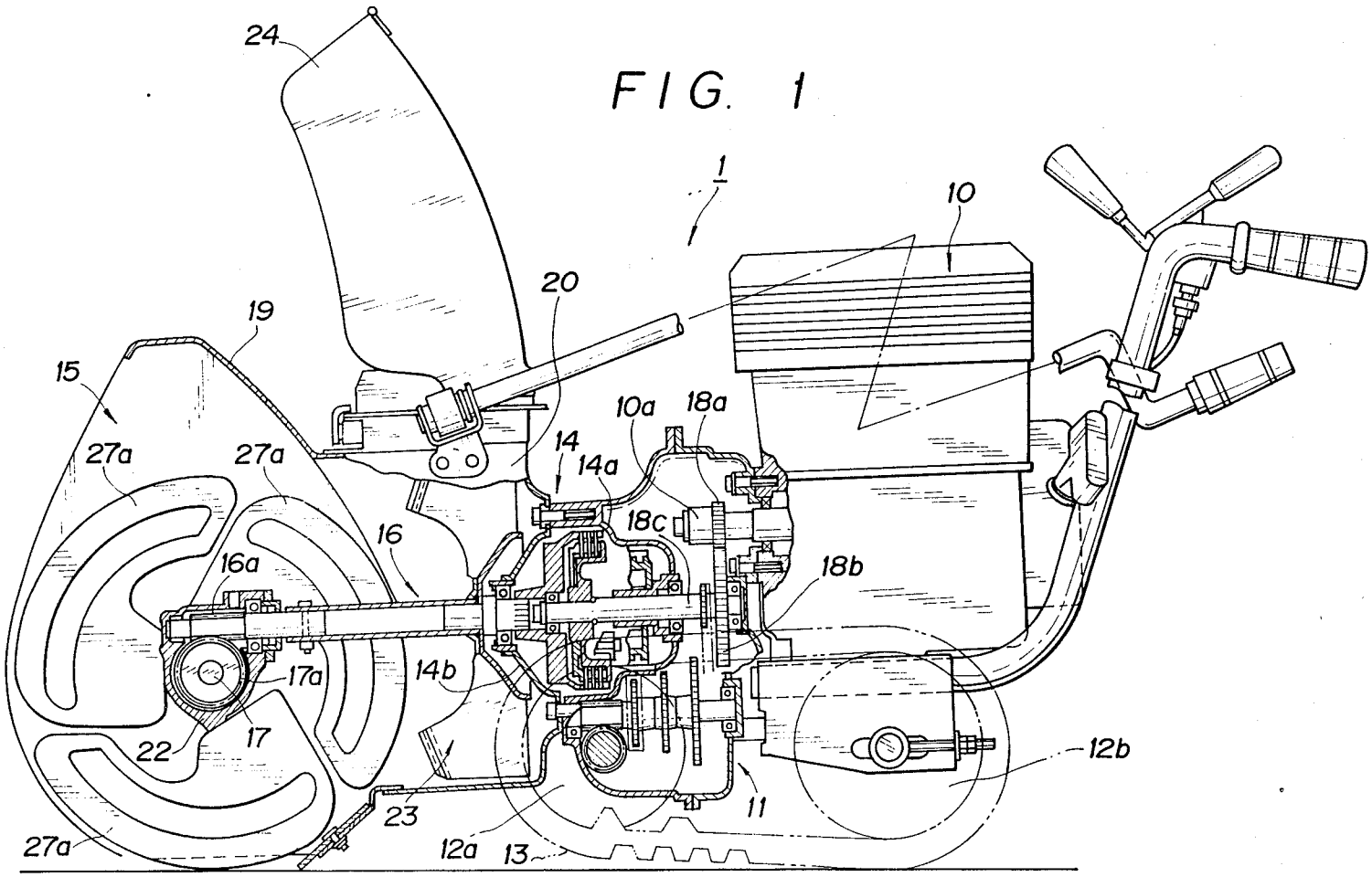
FIG. 1 is a side elevational view, partly cut away, of a self-propelled snow removing machine having an auger structure according to a first embodiment of the present invention.

As shown in FIG. 1, a self-propelled snow-removing tractor or snow removing machine, generally designated by the reference numeral 1, has an engine 10 for driving a pair of laterally spaced crawlers 13, an auger 15, and a snow blower 23. The engine 10 has an output shaft 10*a* which drives gears 18*a*, 18*b* and also driver wheels 12*a* for the crawlers 13 through a gear transmission 11. The crawlers 13 are positioned one on each side of the body of the snow removing machine and trained around the driver wheels 12*a* and driven wheels 12*b*. The gear 18*b* has a shaft 18*c* coupled to a blower/auger input shaft 16 through a clutch 14 disposed in a clutch housing 14*a*. The input shaft 16 is positioned centrally in the transverse direction of the snow removing machine and extends longitudinally through a blower housing 20 and an auger cover 19. The input shaft 16 has an end rotatably supported by a bearing in a cover 14*b* which constitutes a front portion of the clutch housing 14*a*. The input shaft 16 also has on its front end a worm 16*a* meshing with a worm wheel 17*a* on the center of an auger drive shaft 17 extending transversely through the auger cover 19. The worm 16*a* and the worm wheel 17*a* jointly constitute an auger transmission 22. The snow blower 23 is connected to the end portion of the input shaft 16 near the bearing in the cover 146 for rotation with the input shaft 16. The snow blower 23 when rotated discharges through a duct 24 snow that has been collected by the auger 15 and pushed from the auger cover 19 into the blower housing 20.

Figure 2:
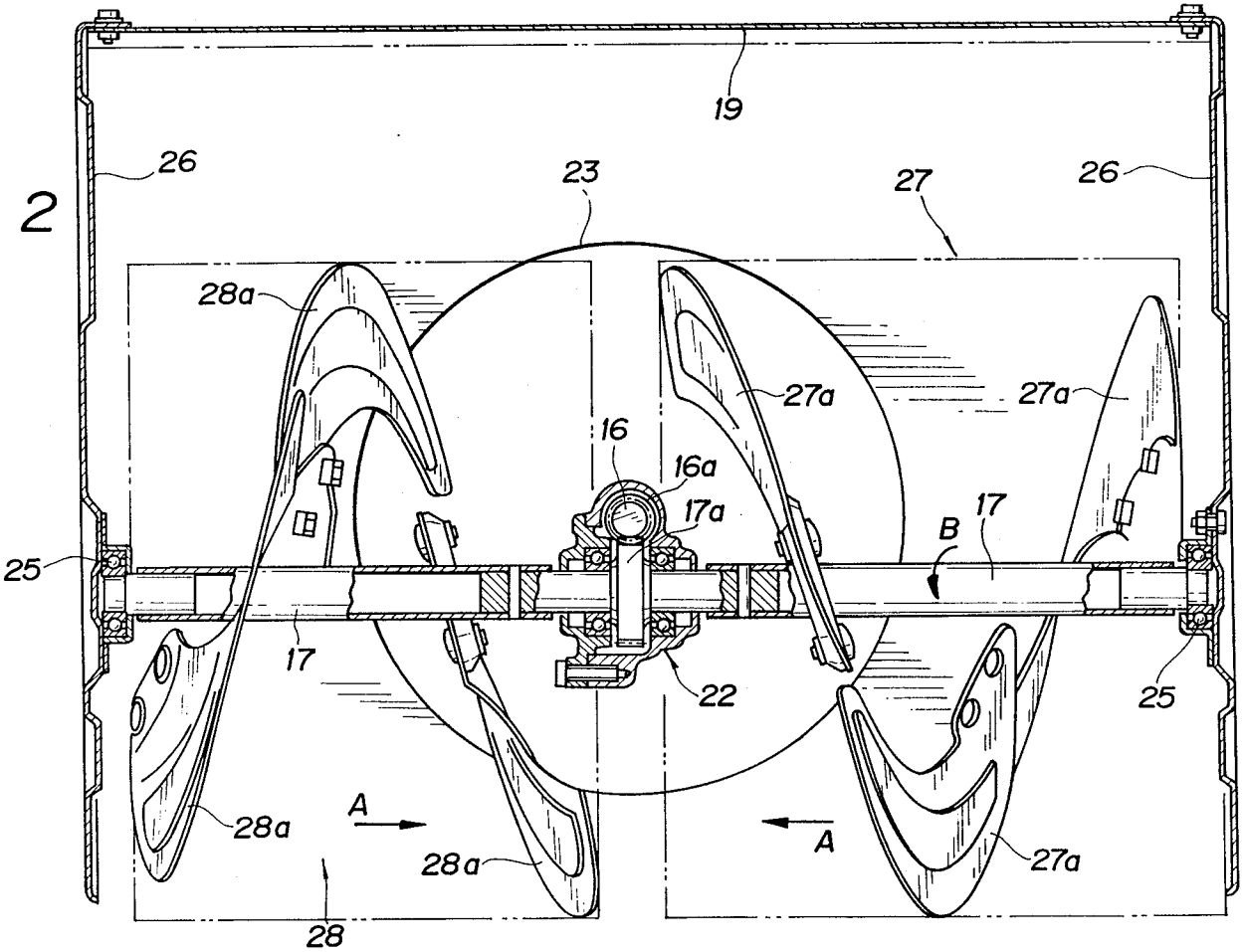
FIG. 2 is a front elevational view of the auger structure.
Figure 5:
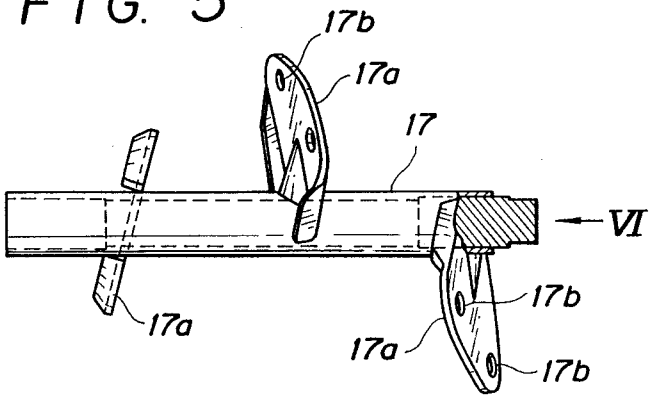
FIG. 5 is a perspective view showing a fin attachment portion of the auger drive shaft.
Figure 6:
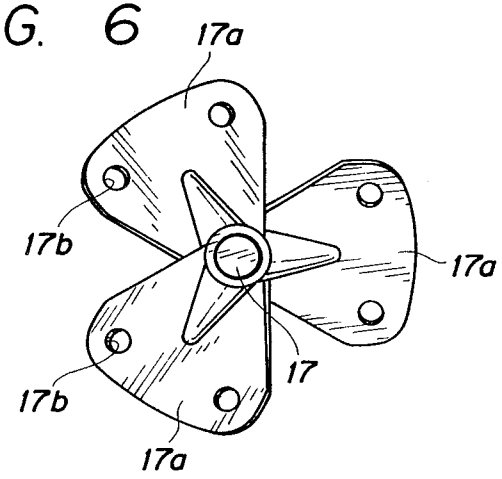
FIG. 6 is a view as viewed in the direction of the arrow VI in FIG. 5.
Figure 3:
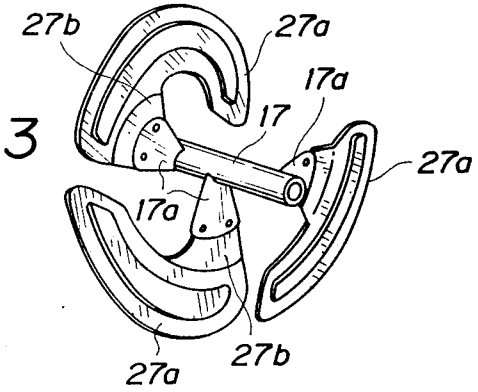
FIG. 3 is a perspective view of an auger blade.

As shown in FIG. 2, the opposite ends of the auger drive shaft 17 are rotatably supported on auger side covers 26, respectively, by means of bearings 25. The auger drive shaft 17 is rotated about its own axis in the direction of the arrow B when the input shaft 16 is rotated. Blades 27, 28 are attached to the auger drive shaft 17 respectively on opposite sides of the auger transmission 22. The righthand blade 27 comprises three separate fins 27*a*, whereas the lefthand blade 28 comprises three separate fins 28*a*. When the auger drive shaft 17 is rotated counterclockwise in FIG. 1, snow positioned in front of the auger 15 is collected by the blades 27, 28 toward the center in the transverse direction of the snow removing machine, as indicated by the arrows A, and also in the rearward direction, and then is discharged by the snow blower 23. The blades 27, 28 are angularly positioned 180° out of phase with each other, but are otherwise the mirror image of each other, and the fins 27*a*, 28*a* are also of the mirror image of each other. Therefore, only the blade 27 will be described below.

As illustrated in FIGS. 3 through 6, the three fins 27*a* of the blade 27 have inner apexes or bases 27*b* detachably attached to three respective radially outward brackets 17*a* welded to the auger drive shaft 17 by means of bolts 29 and nuts 30, the bolts 29 having their axes substantially parallel to the axis of the auger drive shaft 17. The brackets 17*a* are positioned such that the outer peripheral edges of the fins 27*a* jointly form a substantially continuous helix around the auger drive shaft 17. The helix covers substantially the entire length of the auger drive shaft 17 in its axial direction. This helical arrangement allows the blade 27 to follow a cylindrical path around the auger drive shaft 17 when it is rotated. The base 27*b* of each of the fins 27*a* has two spaced bolt insertion holes 27*c*, and each bracket 17*a* has two spaced bolt insertion holes 17*b* to be registered with the bolt insertion holes 27*c*, respectively. The bolt insertion holes 27*c* of the fin 27*a* are of a rectangular shape complementary with the rectangular heads of the bolts 29, and the bolt insertion holes 17*b* of the bracket 17*a* are of a circular shape. The rectangular bolt insertion holes 27*c* prevent the bolts 29 from turning with respect to the fin 27*a* and reduce the amount of projection of the heads of the bolts 29 beyond the surface of the fin 27*a*.

Figure 4:
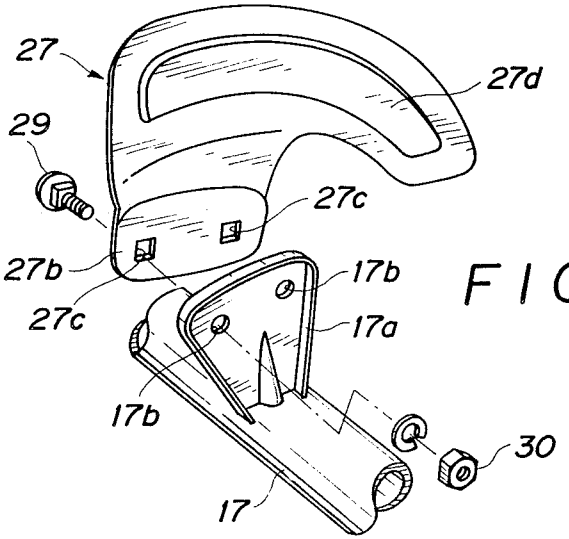
FIG. 4 is an exploded perspective view showing the manner in which a single fin is attached to an auger drive shaft.
Figure 7:
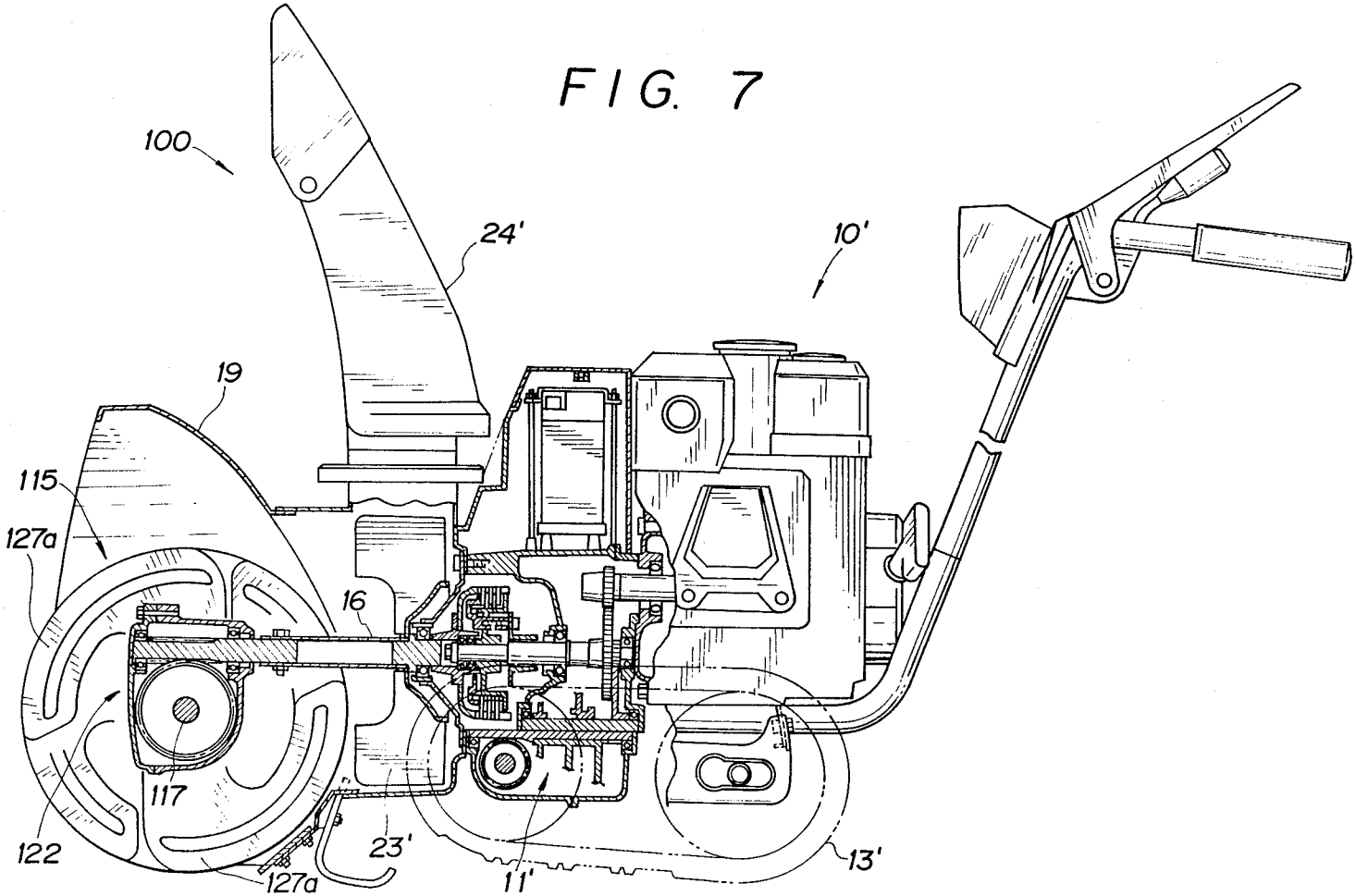
FIG. 7 is a side elevational view, partly cut away, of a self-propelled snow removing machine having an auger structure according to a second embodiment of the present invention.
Figure 11:
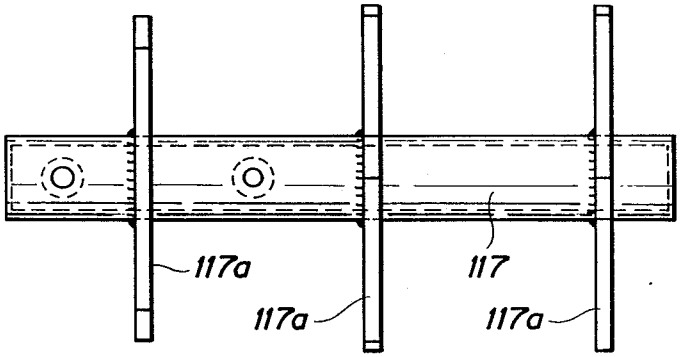
FIG. 11 is a front elevational view of an auger shaft assembly.
Figure 12:
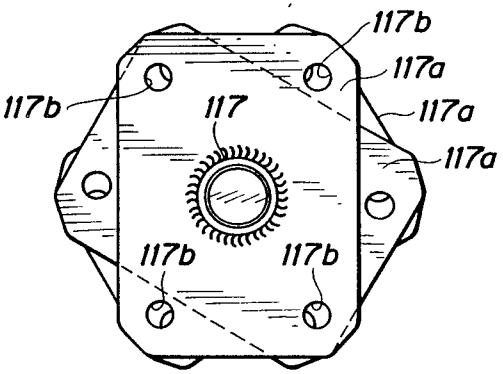
FIG. 12 is a view as viewed in the direction of the arrow XII in FIG. 11.

As shown in FIG. 4, each fin 27*a* comprises the flat attachment base 27*b* to be attached to the auger drive shaft 17, and an arcuate portion 27*d* extending helically from the outer end of the base 27*b*, the base 27*b* extending substantially perpendicularly to the axis of the auger drive shaft 17. The fins 27*a* are made of a resilient steel sheet material, preferably spring steel such as carbon steel of S35C or more, or SUP, which has been heat-treated.

Rotative power from the engine 10 is transmitted through the gears 18*a*, 18*b* and the transmission 11 to the driver wheels 12*a* to drive the crawlers 13. The engine power is also transmitted through the auger transmission 22 to the auger drive shaft 17 to rotate the same. Therefore, the blades 27, 28 of the auger 15 are rotated in a prescribed direction to collect snow in front of the auger 15 toward the center in the transvese direction of the snow removing machine and also in the rearward direction. The collected snow is thereafter discharged by the snow blower 23.

As described above, the outer peripheral edges of the blades 27, 28 form a substantially continuous helix around the auger drive shaft 17, which covers substantially the entire length of the drive shaft 17 in its axial direction. The blades 27, 28 comprise the fins 27*a*, 28*a* of resilient steel. Therefore, even when small stones or foreign matter enters between the inner surface of the auger cover 19 and the outer peripheral edges of the blades 27, 28 during operation of the snow removing machine 1, the fins 27*a*, 28*a* are only caused to flex slightly by such small stones, which can thus be automatically removed. As a result, the blades 27, 28 and the auger cover 19 are prevented from being damaged. Since the blades 27, 28 are constructed of mutually separate fins 27*a*, 28*a*, the blades 27, 28 are not required to be replaced in their entirety when one of the fin 27*a*, 28*a* is broken. Accordingly, the maintenance procedure for the snow removing machine 1 is simplified.

While the snow removing machine 1 is in operation, the blades 27, 28 are subject to reactive forces from snow in the direction opposite to the direction of the arrows A in FIG. 1. Inasmuch as the axes of the bolts 29 extend parallel to the axis of the auger drive shaft 17, the reactive forces acting on the blades 27, 28 do not turn the bolts 29. Consequently, the bolts 29 and the nuts 30 are prevented from being loosened during use of the snow removing machine 1.

Each of the fins 27*a* comprises the flat base 27*b* attached to the auger drive shaft 17 and the arcuate portion 27*d* extending helically from the outer end of the base 27*b*. As the arcuate portion 27*d* covers a wider angle than the conventional racket-shaped fins, the number of parts of the auger structure of the invention is relatively small.

FIGS. 7 through 16 show a self-propelled snow removing machine 100 having an auger structure according to a second embodiment of the present invention. Those parts of the second embodiment which are identical to those of the first embodiment are denoted by identical reference numerals, and those similar to those of the first embodiment are denoted by identical reference numerals with an apostrophe (′), and will not be described in detail.

An auger drive shaft 117 is transversely supported in the auger cover 19 of the snow removing machine 100, and is rotated by the blower/auger input shaft 16 through an auger transmission 122.

Figure 8:
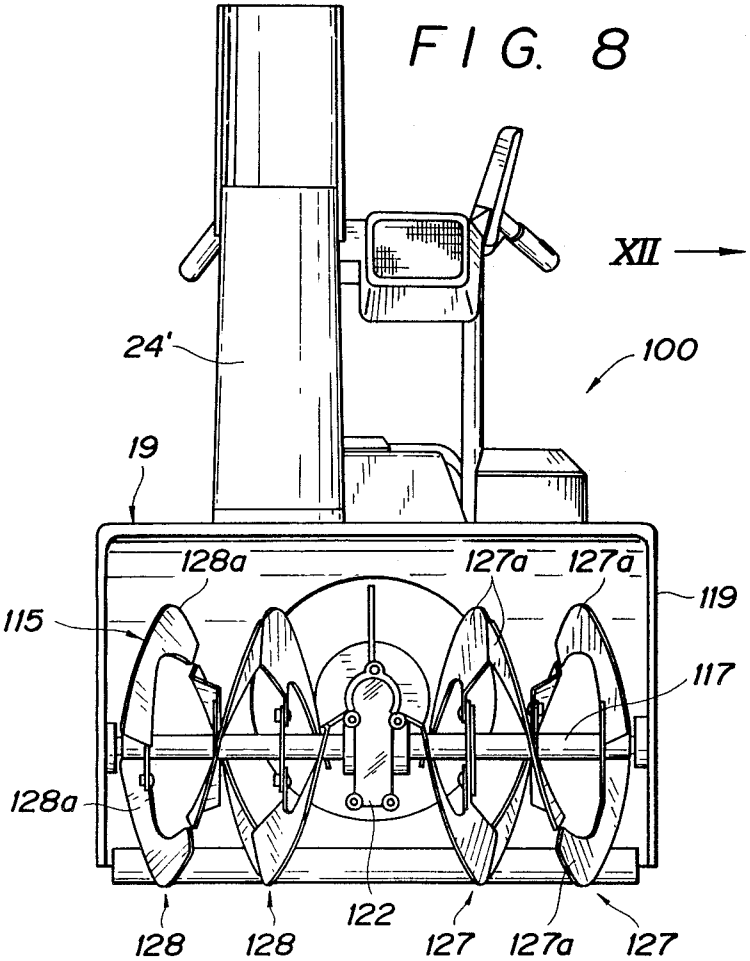
FIG. 8 is a front elevational view of the snow removing machine shown in FIG. 7, showing the auger structure.

As shown in FIG. 8, two pairs of blades 127, 128 are mounted on the auger drive shaft 117 one on each side of the auger transmission 122. Each of the lefthand blades 128 comprises three fins 128*a*, whereas each of the righthand blades 127 comprises three fins 127*a*. The blades 128 on the auger drive shaft 117 are 180° out of phase with each other, and likewise the blades 127 on the auger drive shaft 117 are 180° out of phase with each other. The blades 127 and the blades 128 are the mirror image of each other. Therefore, only the blades 127 will be described below, and the structure of the blades 128 can easily be understood from the description of the blades 127.

Figure 9:
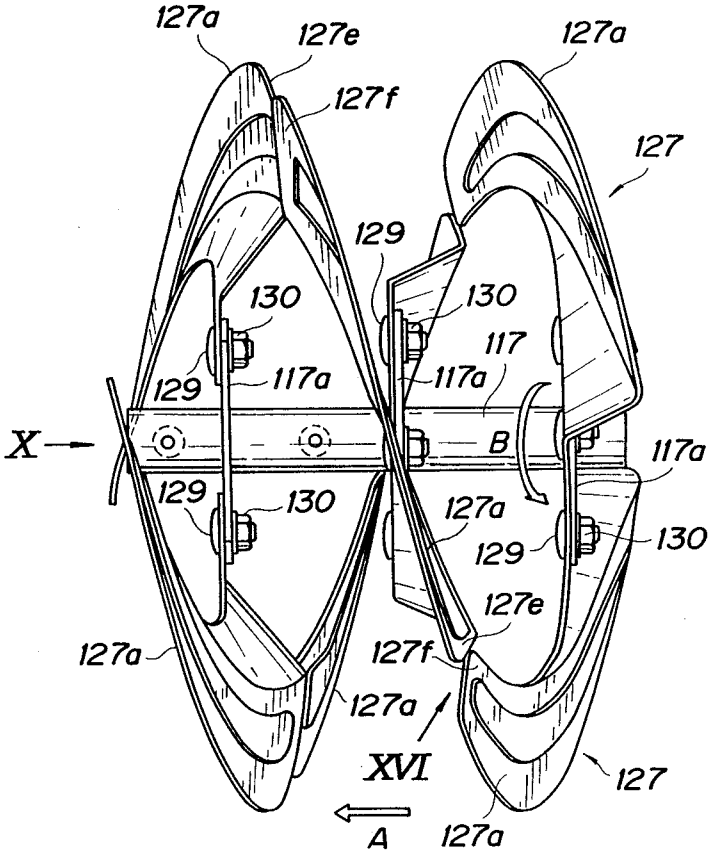
FIG. 9 is a front elevational view of the auger structure of FIG. 7.

As shown in FIGS. 9 through 12, the three fins 127*a* of each of the blades 127 have respective bases 127*b* detachably fixed to three respective flanges 117*a* welded at prescribed intervals to the auger drive shaft 117 by means of bolts 129 and nuts 130. The bolts 129 have their axes extending parallel to the axis of the auger drive shaft 117. Each of the flanges 117*a* has four circular bolt insertion holes 117*b*. These flanges 117*a* are welded to the auger drive shaft 117 at positions which are successively 60° out of phase, i.e., angularly spaced. The three fins 127*a* of one of the blades 127 have outer peripheral edges forming a substantially continuous first helix around the auger drive shaft 117, whereas the three fins 127*a* of the other blade 127 have outer peripheral edges forming a substantially continuous second helix around the auger drive shaft 117. The second helix is 180° out of phase or angularly spaced from the first helix around the auger drive shaft 117. In FIG. 9, the auger drive shaft 117 rotates about its own axis in the direction of the arrow B, and snow as collected by the blades.127 is moved in the direction of the arrow A which is parallel to the axis of the auger drive shaft 117.

As shown in FIGS. 13 through 15, the flat base 127*b* of each of the fins 127*a* has two spaced rectangular holes 127*c* through which the bolts 129 are inserted, respectively. The fin 127*a* has the base 127*b* attached substantially perpendicularly to the auger drive shaft 117 and also includes an arcuate portion 127*d* extending helically from the outer end of the base 127*b*. The fins 127*a* are made of a resilient steel sheet material, preferably spring steel such as carbon steel of S35C or more, or SUP, which has been heat-treated. Accordingly, the fins 127*a* are prevented from being deformed when small stones or other foreign matter enters between the fins 127*a* and the auger cover 19. The arcuate portion 127*d* of each fin 127*a* has an arcuate edge 127*h* of a relatively large radius of curvature at an end 127*e* near the base 127*b*, and a rib 127*g* extending arcuately along its center in the transverse direction thereof. As shown in FIG. 14, the arcuate portion 127*d* is twisted such that the end 127*e* of the arcuate portion 127*d* and an opposite distal end 127*f* thereof are locate forwardly and rearwardly of the base 127*b* transversely thereof.

As shown in FIG. 9, as the auger drive shaft 117 rotates, the three fins 127*a* of each of the blades 127 are successively caused to bite into snow from the base end 127*e* toward the distal end 127*f* of the arcuate portion 127*d* to collect the snow in the direction of the arrow A.

Figure 10:
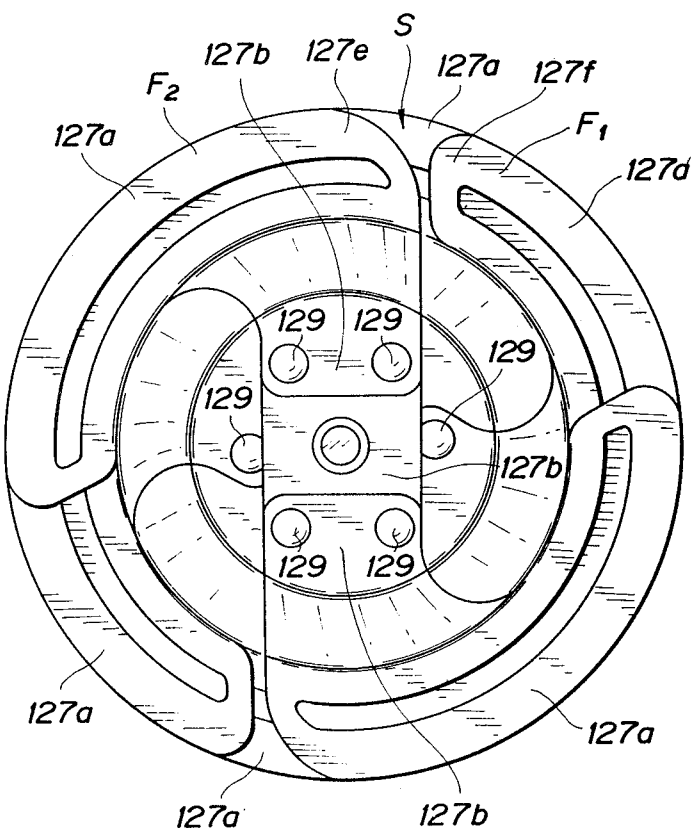
FIG. 10 is a view as viewed in the direction of the arrow X in FIG. 9.

As illustrated in FIG. 10, two successive fins F1, F2 (i.e., 127*a*, 127*a*) are spaced from each other in side elevation, defining a small gap S between the distal end 127*f* of one of the fins F1 and the base end 127*e* of the other fin F2. The gap S allows small stones or other foreign matter that has entered between the fins and the auger cover to escape through the gap S relatively easily.

In FIG. 16, the distal end 127*f* of one of the fins 127*a* in its free state is spaced a distance H from the base end 127*e* of the next fin 127*a* in the direction of the arrow A in which snow is collected. The distance H is selected such that the distal end 127*f* of one fin 127*a*, as it is fleed by the reactive force of collected snow, is aligned with the base end 127*e* of the next fin 127*a*.

The auger 115 of the second embodiment offers the same advantages as those of the auger of the first embodiment.

As described above, the distal end 127*f* of one of the fins 127*a* in its free state is spaced the distance H from the base end 127*e* of the next fin 127*a* in the direction of the arrow A, and the distal end 127*f* can be flexed into alignment with the base end 127*e* of the next fin 127*a* under the reactive forces of snow being collected. Therefore, snow can effectively be collected without leakage by the successive fins 127*a* which are continuously held in helical alignment at their ends 127*e*, 127*f* during operation of the auger 115, in the same manner as the conventional augers with continuous blades.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

We claim:

1. An auger in a self-propelled snow removing machine including an engine, running means drivable by the engine, and a snow blower for discharging snow collected by the auger, said auger comprising an auger cover disposed on a front portion of the snow removing machine, an auger output shaft disposed transversely in the auger cover and drivable by the engine, and at least one blade mounted on the auger output shaft and having an outer peripheral edge forming a substantially continuous helix around the auger output shaft wherein:

said blade comprises a plurality of mutually separate fins having outer peripheral edges jointly forming the helix and made of a resilient steel material so that the blade can resiliently flex when small stones and the like enter between the blade and the auger cover;

each of said fins comprising a flat base attached to said auger output shaft substantially perpendicularly to an axis thereof, and an arcuate portion extending helically from an outer end of said base so that snow can be collected in an axial direction of said auger output shaft and thereafter discharged by said snow blower; and said arcuate portion of each of said fins has an arcuate edge of a relatively large radius of curvature at a base end thereof so that a small gap is defined in side elevation between a distal end of the arcuate portion of one fin and the base end of the arcuate portion of another fin following said one fin.

2. An auger according to claim 1, wherein each of said fins is detachably fixed to said auger output shaft.

3. An auger according to claim 1, wherein said arcuate portions of each of said fins has a base end and an opposite distal end, said distal end of one fin being spaced a distance from said base end of a next fin in said axial direction.

4. An auger according to claim 1, wherein said blade fins are made of spring steel.

5. An auger according to claim 1, wherein said snow blower is positioned transversely centrally of said snow removing machine and rearwardly of said auger.

6. An auger in a self-propelled snow removing machine including an engine, running means drivable by the engine, and a snow blower for discharging snow collected by the auger, said auger comprising an auger cover disposed on a front portion of the snow removing machine, an auger output shaft disposed transversely in the auger cover and drivable by the engine, and at least one blade mounted on the auger output shaft and having an outer peripheral edge forming a substantially continuous helix around the auger output shaft, wherein:

said blade comprises a plurality of mutually separate fins having outer peripheral edges jointly forming the helix and made of a resilient steel material so that the blade can resiliently flex when small stones and the like enter between the blade and the auger cover;

each of said fins comprising a flat base attached to said auger output shaft substantially perpendicularly to an axis thereof, and an arcuate portion extending helically from an outer end of said base so that snow can be collected in an axial direction of said auger output shaft and thereafter discharged by said snow blower; and each of said fins is detachably fixed to said auger output shaft by means of bolts and nuts, said bolts having axes extending substantially parallel to said axial direction of said auger output shaft.

7. An auger according to claim 6, wherein said arcuate portions of each of said fins has a base end and an opposite distal end, said distal end of one fin being spaced a distance from said base end of a next fin in said axial direction.

8. An auger according to claim 6, wherein said blade fins are made of spring steel.

9. An auger according to claim 6, wherein said snow blower is positioned transversely centrally of said snow removing machine and rearwardly of said auger.

10. An auger in a self-propelled snow removing machine including an engine, running means drivable by the engine, and a snow blower for discharging snow collected by the auger, said auger comprising an auger cover disposed on a front portion of the snow removing machine, an auger output shaft disposed transversely in the auger cover and drivable by the engine, and at least one blade mounted on the auger output shaft and having an outer peripheral edge forming a substantially continuous helix around the auger output shaft, wherein:

said blade comprises a plurality of mutually separate fins having outer peripheral edges jointly forming the helix and made of a resilient steel material so that the blade can resiliently flex when small stones and the like enter between the blade and the auger cover;

each of said fins comprising a flat base attached to said auger output shaft substantially perpendicularly to an axis thereof, and an arcuate portion extending helically from an outer end of said base so that snow can be collected in an axial direction of said auger output shaft and thereafter discharged by said snow blower;

said arcuate portion of each of said fins has a base end and an opposite distal end, said distal end of one fin being spaced a distance from said base end of a next fin in said axial direction; and said distance is sized such that said distal end of one fin becomes aligned with said base end of a next fin as said one fin is flexed by a reactive force of snow collected by said auger.

11. An auger according to claim 10, wherein each of said fins is detachably fixed to said auger output shaft.

12. An auger according to claim 10, wherein said blade fins are made of spring steel.

13. An auger according to claim 10, wherein said snow blower is positioned transversely centrally of said snow removing machine and rearwardly of said auger.

* * * * *

UNITED STATES PATENT AND TRADEMARK OFFICE
CERTIFICATE OF CORRECTION

PATENT NO. : 4,899,471

DATED : February 13, 1990

INVENTOR(S) : Ichiro Sasaki, et al

It is certified that error appears in the above-identified patent and that said Letters Patent is hereby corrected as shown below:

Column 6, line 16, change "fleed" to --flexed--.

In the Drawings, after Sheet 6 add Sheet 7 containing Figs. 13-16 as attached hereto.

Signed and Sealed this

Tenth Day of September, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,899,471

DATED : February 13, 1990

INVENTOR(S) : Ichiro SASAKI et al

It is certified that error appears in the above-identified patent and that said Letters Patent is hereby corrected as shown below:

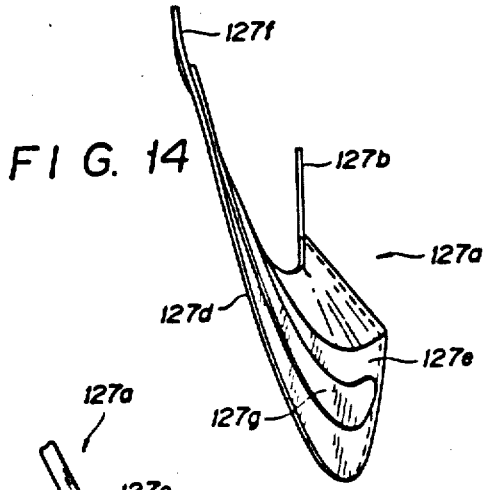

FIG. 14

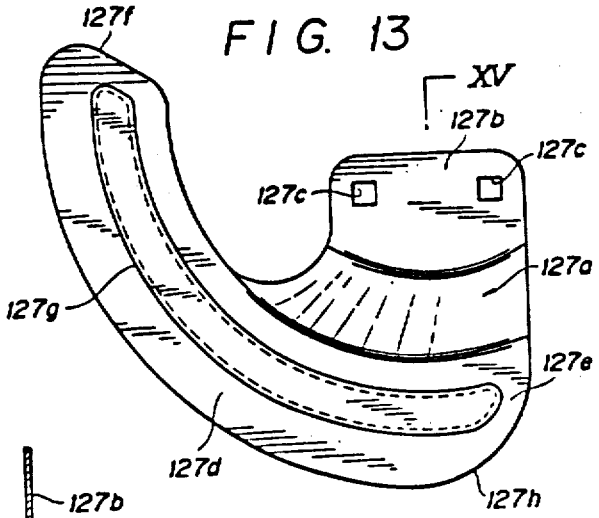

FIG. 13

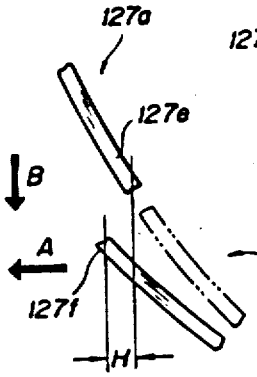

FIG. 16

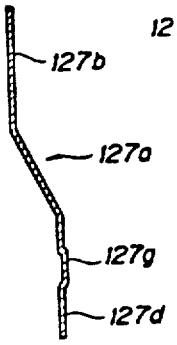

FIG. 15